US006497217B2

(12) United States Patent
Kojima

(10) Patent No.: US 6,497,217 B2
(45) Date of Patent: Dec. 24, 2002

(54) HIGH-PRESSURE FUEL SUPPLY SYSTEM AND METHOD OF SUPPLYING FUEL

(75) Inventor: Susumu Kojima, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 58 days.

(21) Appl. No.: 09/866,807

(22) Filed: May 30, 2001

(65) Prior Publication Data

US 2001/0054412 A1 Dec. 27, 2001

(30) Foreign Application Priority Data

Jun. 21, 2000 (JP) ..... 2000-191083

(51) Int. Cl.[7] ..... F02M 37/00; F02M 55/02
(52) U.S. Cl. ..... 123/456; 123/461; 123/516
(58) Field of Search ..... 123/179.16, 446, 123/447, 456, 457, 461, 511, 516

(56) References Cited

U.S. PATENT DOCUMENTS

| | | | | |
|---|---|---|---|---|
| 4,667,638 A | | 5/1987 | Igashira et al. | 123/446 |
| 5,546,912 A | | 8/1996 | Yamada et al. | 123/511 |
| 5,839,413 A | * | 11/1998 | Krause et al. | 123/447 |
| 5,884,597 A | | 3/1999 | Hiraku et al. | 123/179.17 |
| 6,021,763 A | * | 2/2000 | Yoshihara et al. | 123/516 |
| 6,073,597 A | | 6/2000 | Harata et al. | 123/179.14 |

FOREIGN PATENT DOCUMENTS

| | | | | |
|---|---|---|---|---|
| DE | 199 23 302 A1 | | 11/2000 | |
| JP | 60-219448 A | | 11/1985 | |
| JP | 5-321787 A | | 12/1993 | |
| JP | 7-167009 A | | 7/1995 | |
| JP | 10-61511 | * | 3/1998 | F02M/37/00 |
| JP | 2000-45905 | * | 2/2000 | F02M/55/02 |

* cited by examiner

*Primary Examiner*—Tony M. Argenbright
(74) *Attorney, Agent, or Firm*—Oliff & Berridge PLC

(57) ABSTRACT

A high-pressure fuel supply system has a reservoir for supplying high-pressure fuel to fuel injectors, a low-pressure pump that withdraws fuel from a fuel tank and that discharges fuel at a pressure substantially equal to or higher than a predetermined pressure since the starting of an internal combustion engine, a high-pressure pump for force-feeding high-pressure fuel to the reservoir, a pressure booster that boosts a pressure of fuel in the reservoir when starting the internal combustion engine, and a fuel passage that allows fuel to flow only from the fuel tank to the reservoir so as to prevent fuel vapors from being generated in the reservoir while the engine is out of operation. Thus, it becomes possible to reliably boost a pressure in the reservoir when starting the internal combustion engine.

24 Claims, 4 Drawing Sheets

HIGH-PRESSURE FUEL SUPPLY SYSTEM AND METHOD OF SUPPLYING FUEL

INCORPORATION BY REFERENCE

The disclosure of Japanese Patent Application No. 2000-191083 filed on Jun. 21, 2000, including the specification, drawings and abstract is incorporated herein by reference in its entirety.

BACKGROUND OF THE INVENTION

1. Field of Invention

The invention relates to a high-pressure fuel supply system for fuel injection in an internal combustion engine and to a method of supplying fuel.

2. Description of Related Art

In order to inject fuel directly into cylinders of an internal combustion engine, it is necessary to supply high-pressure fuel to fuel injection valves. High-pressure fuel supply systems for this purpose are known.

In general, a high-pressure fuel supply system has a reservoir leading to fuel injection valves, a high-pressure pump for force-feeding high-pressure fuel to the reservoir, and a low-pressure pump that is connected to the high-pressure pump on its intake side to ensure that the high-pressure pump withdraws fuel from a fuel tank. In general, the low-pressure pump is of an electrically driven type and can force-feed fuel at a rated discharge pressure since the starting of an engine, whereas the high-pressure pump is of an engine driven type. Because the internal combustion engine is driven by a starter motor and is at a low speed when it is started, the high-pressure pump cannot force-feed fuel well when the engine is started.

Thus, various propositions have been made including a proposition to boost a pressure in the reservoir to a rated discharge pressure (e.g., 0.3 MPa) of the low-pressure pump and to start fuel injection. However, this pressure is much lower than a target high fuel pressure (e.g., 12 MPa) in the reservoir during normal operation, and it is difficult to realize good fuel injection.

In order to solve this problem, Japanese Patent Application Laid-Open No. 5-321787 employs a pressure-boosting pump having a large-diameter piston and a small-diameter piston that are connected to each other in the axial direction. When starting an engine, a discharge pressure of a low-pressure pump is applied to the large-diameter piston so that the large-diameter piston and the small-diameter piston are displaced in the axial direction. Thus, the pressure of fuel in a small-diameter cylinder is boosted by the small-diameter piston by an amount corresponding to a ratio between pressure-receiving areas of the large-diameter piston and the small-diameter piston. It has been proposed to force-feed this pressure-boosted fuel to a reservoir that is connected to the small-diameter cylinder so as to boost a pressure in the reservoir to a pressure higher than a rated discharge pressure of the low-pressure pump.

Meanwhile, since fresh fuel is continuously supplied to the reservoir from a fuel tank while the engine is in operation, the temperature of fuel in the reservoir is lower than the temperature of a reservoir housing. However, after the engine has been stopped, fresh fuel is no longer supplied and the temperature of fuel in the reservoir becomes substantially equal to the temperature of the reservoir housing. Thus, immediately after the engine has been stopped, fuel in the reservoir receives heat from the reservoir housing, is heated up, and expands thermally. The reservoir is generally provided with a safety valve to prevent the pressure of fuel in the reservoir from rising above a predetermined level. Thus, the safety valve is operated by thermal expansion of fuel immediately after the engine has been stopped, and the pressure of fuel in the reservoir is maintained at a predetermined value.

After that, the temperature of the reservoir housing and fuel gradually falls to an outside air temperature. However, since fuel has a greater thermal expansion coefficient than the reservoir that is generally made from a metal, fuel thermally contracts more greatly than the reservoir housing in proportion to a fall in temperature. The pressure of fuel (i.e., the pressure in the reservoir) eventually becomes negative, and fuel vapors are generated in the reservoir.

In the case where such fuel vapors are generated in the reservoir, even if a pressure booster as described above is operated when starting the engine, some or all of the fuel that is force-fed from the small-diameter cylinder to the reservoir is used to eliminate the fuel vapors. Therefore, the pressure in the reservoir cannot be boosted as desired.

SUMMARY OF THE INVENTION

The invention has been made as a solution to the problem described above. It is thus one object of the invention to provide a high-pressure fuel supply system having a high-pressure pump, a low-pressure pump that can discharge fuel substantially at a rated discharge pressure since the starting of an engine, and a pressure booster for boosting a pressure of fuel in a reservoir to a pressure higher than a discharge pressure of the low-pressure pump when starting the engine, wherein the pressure booster can reliably boost a pressure in the reservoir when starting the engine even if there is a difference in thermal expansion coefficient between the reservoir housing and fuel.

A high-pressure fuel supply system according to one aspect of the invention comprises a reservoir for supplying fuel injection valves with high-pressure fuel, a high-pressure pump for force-feeding high-pressure fuel to the reservoir, a low-pressure pump that can discharge fuel substantially at a rated discharge pressure since the starting of an engine, a pressure booster that boosts a pressure of fuel in the reservoir when starting the engine, and a fuel passage that allows fuel to flow only from the fuel tank to the reservoir so as to prevent fuel vapors from being generated in the reservoir while the engine is out of operation.

Even if there is a difference in thermal expansion coefficient between a reservoir housing and fuel, the fuel passage prevents fuel vapors from being generated due to a negative pressure in the reservoir while the engine is out of operation. Thus, the pressure booster can reliably boost a pressure in the reservoir when starting the engine.

A high-pressure fuel supply system according to another aspect of the invention comprises a reservoir for supplying fuel injection valves with high-pressure fuel, a high-pressure pump for force-feeding high-pressure fuel to the reservoir, a low-pressure pump that can discharge fuel substantially at a rated discharge pressure since the starting of an engine, a pressure booster that boosts a pressure of fuel in the reservoir when starting the engine, and a delay device that delays operation of the pressure booster at least until fuel vapors in the reservoir are eliminated.

Other aspects of the invention involve methods of supplying high-pressure fuel.

BRIEF DESCRIPTION OF THE DRAWINGS

The above-mentioned embodiment and other embodiments, objects, features, advantages, technical and industrial significance of this invention will be better understood by reading the following detailed description of preferred embodiments of the invention, when considered in connection with the accompanying drawings, in which.

DETAILED DESCRIPTION OF PREFERRED EMBODIMENTS

In the following description and the accompanying drawings, the present invention will be described in more detail with reference to exemplary, preferred embodiments.

Figure 1A:
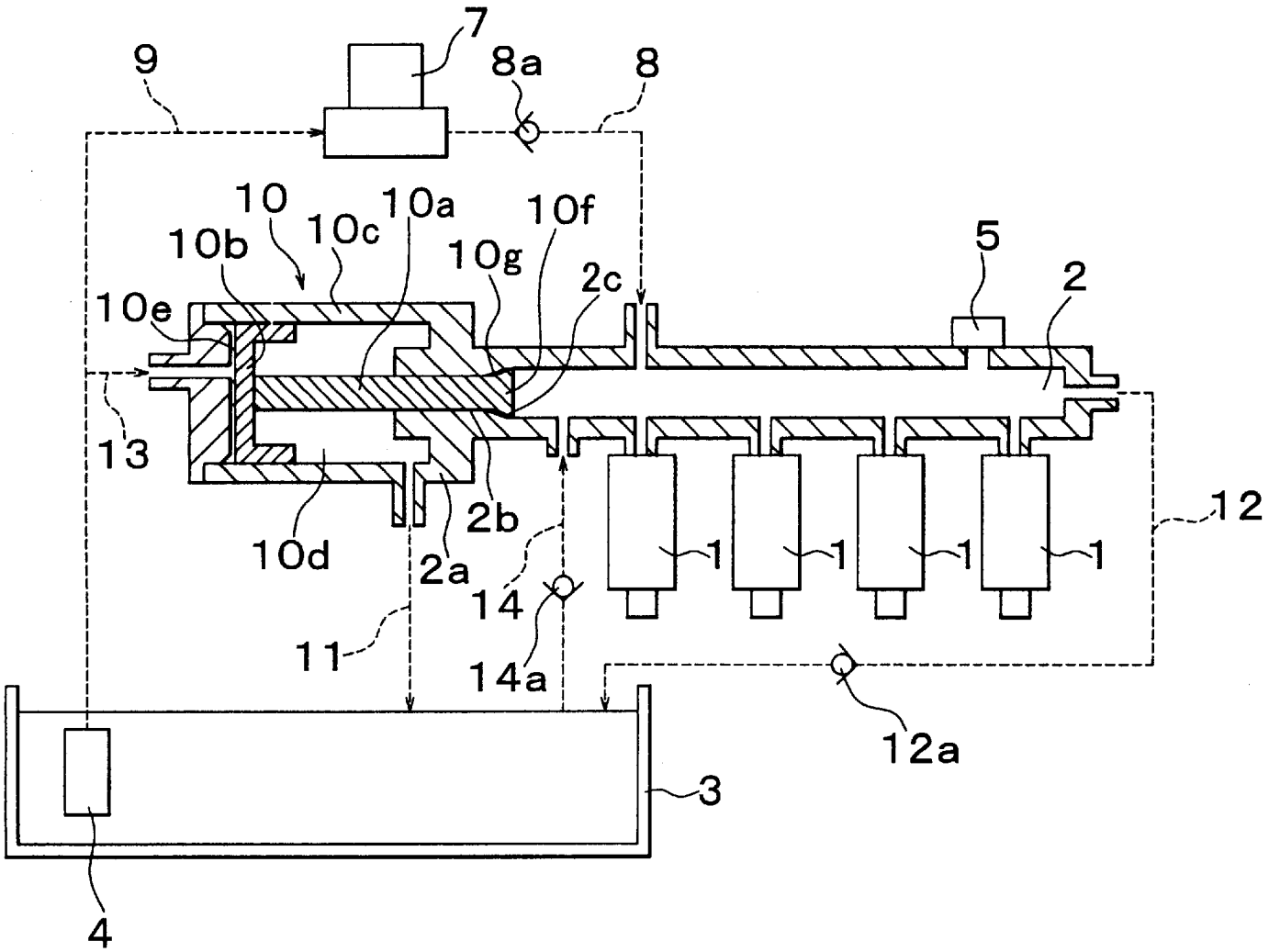
FIG. 1A is a schematic view of a high-pressure fuel supply system for fuel injection in an internal combustion engine according to a first embodiment of the invention.

FIG. 1A is a schematic view of a high-pressure fuel supply system for fuel injection in an internal combustion engine according to a first embodiment of the invention. The internal combustion engine will be described hereinafter as an engine having four cylinders. However, the invention is not limited thereto but is also applicable to an internal combustion engine having six cylinders, eight cylinders, more than eight cylinders, less than four cylinders, etc. In FIG. 1A, a reservoir 2 supplies high-pressure fuel to four fuel injection valves that are disposed in cylinders of the internal combustion engine respectively. The reservoir 2 is provided with a pressure sensor 5 that detects a pressure of fuel in the reservoir 2. Disposed in each of the fuel injection valves 1 is a valve body for opening and closing an injection hole and a solenoid for attracting the valve body in its opening direction. A spring force and a pressure of fuel in the reservoir 2 are applied to the valve body in its closing direction. If the solenoid has been demagnetized, reliable closing of the valve body is guaranteed, and fuel injection is stopped. If the solenoid has been excited, it attracts the valve body S in its opening direction against the spring force and the pressure of fuel, and fuel injection is carried out.

A low-pressure pump 4 is disposed in a fuel tank 3. The low-pressure pump 4 is a battery-driven electric pump and has a rated discharge pressure of, e.g., 0.3 MPa. The low-pressure pump 4 is operated in response to an ON-signal from a starter switch. Disposed in the low-pressure pump 4 on its intake side is a filter (not shown) that prevents admission of foreign matters when fuel is withdrawn from the fuel tank 3.

A high-pressure pump 7 maintains the pressure of fuel in the reservoir 2 close to a target high fuel pressure of, e.g., 12 MPa. The high-pressure pump 7 is of an engine-driven type wherein fuel is force-fed by a plunger that is driven by a cam connected to a crank shaft. In this embodiment, a discharge stroke of the high-pressure pump 7 occurs every time fuel injection is carried out in two cylinders.

The high-pressure pump 7 is connected on its discharge side to the reservoir 2 via a high-pressure line 8, and is connected on its intake side to a discharge side of the low-pressure pump 4 via a low-pressure line 9. Thus, since fuel that is sucked (withdrawn) from the low-pressure line 9 during a suction stroke of the high-pressure pump 7 has been pressurized to 0.3 MPa by the low-pressure pump 4 as described above, fuel vapors resulting from a negative pressure in the low-pressure line 9 are unlikely to be generated. A check valve 8*a* that opens at a set pressure is disposed in the high-pressure line 8 so as to prevent fuel from flowing backwards due to pressure pulsations generated by the high-pressure pump 7.

The high-pressure pump 7 adjusts a required amount of fuel so that the pressure of fuel in the reservoir 2 becomes equal to a target high fuel pressure, and force-feeds the fuel. Out of all the fuel discharged by the plunger, an unnecessary amount of fuel is returned to the fuel tank 3 via the low-pressure line 9. At this moment, it is undesirable that high-pressure fuel flow backwards in the low-pressure pump 4. Therefore, the low-pressure line 9 may communicate with the fuel tank 3 via a safety valve that opens at a pressure slightly exceeding the rated discharge pressure of the low-pressure pump 4. In order to prevent a pressure of fuel in the reservoir 2 from rising abnormally for some reason, the reservoir 2 and the fuel tank 3 communicate with each other via a return line 12 having a safety valve 12*a* that opens at a fuel pressure slightly exceeding a target high fuel pressure.

If a return line such as the return line 12 is provided, the high-pressure pump 7 may be designed to always force-feed all the fuel discharged by the plunger to the reservoir 2 without adjusting an amount of fuel.

Thus, in either case, if the high-pressure pump 7 operates well after the starting of the engine, the pressure in the reservoir 2 can be maintained at a pressure close to the target high fuel pressure, and fuel injection is carried out well via the fuel injection valves 1. Although the pressure of fuel in the reservoir 2 needs to be boosted quickly when starting the engine, the high-pressure pump 7 is of an engine-driven type and thus does not operate well at a low engine speed realized by a starter motor. Therefore, the pressure in the reservoir 2 cannot be boosted at the time of engine start-up.

On the other hand, the low-pressure pump 4 is of an electrically driven type and thus can operate well even when starting the engine and force-feed fuel at the rated discharge pressure. Thus, the pressure in the reservoir 2 can be quickly made equal to the rated discharge pressure of the low-pressure pump 4. However, as described above, the rated discharge pressure of the low-pressure pump 4 is much lower than the target high fuel pressure. This makes it difficult not only to perform fuel injection in a desired fuel spray mode but also to perform fuel injection at desired timings because injection of a required amount of fuel necessitates prolonging an opening period of the fuel injection valves 1.

The high-pressure fuel supply system of this embodiment has a pressure booster 10 in order to boost the pressure in the reservoir 2 to a pressure higher than the rated discharge pressure of the low-pressure pump 4. The pressure booster 10 has a small-area piston 10*a* that penetrates a hole portion 2*b* formed in one wall portion 2*a* defining the reservoir 2 and that has a variable length of protrusion into the reservoir 2. The small-area piston 10*a* has a uniform circular cross-section slightly smaller in diameter than the hole portion 2*b*, and slides with respect to the hole portion 2*b*. Furthermore, the pressure booster 10 is located outside the reservoir 2 in order to press the small-area piston 10*a* so that its protrusion amount into the reservoir 2 increases. The pressure booster 10 also has a large-area piston 10*b* that has a uniform cross-section larger than the uniform circular cross-section of the small-area piston 10*a*.

A cylinder 10*c* for slidably holding the large-area piston 10*b* is integrated with the one wall portion 2*a*. The small-area piston 10*a*, the hole portion 2*b* in which the small-area piston 10*a* slides, the large-area piston 10*b*, and the cylinder 10*c* in which the large-area piston 10*b* slides have circular cross-sections. However, as long as these sliding movements are possible, the small-area piston 10*a*, the hole portion 2*b*, the large-area piston 10*b*, and the cylinder 10*c* may have a cross-section of an arbitrary shape. For reason of a reduction in weight, the large-area piston 10*b* is bored on the side of the small-area piston 10*a* in the shape of a circular cylinder that is concentric with the small-area piston 10*a*. The small-area piston 10*a* abuts at its end face on a bottom portion that has been formed by boring the large-area piston 10*b*. Although detailed description will be made later, the large-area piston 10*b* need not be integrally connected to the small-area piston 10*a* so as to exclusively perform the function of pressing the small-area piston 10*a*. In a construction in which the large-area piston 10*b* is not connected to the small-area piston 10*a*, a center axis of the cylinder 10*c* along which the large-area piston 10*b* slides and a center axis of the hole portion 2*b* along which the small-area piston 10*a* slides need not coincide with each other as long as they are parallel to each other. Also, the cylinder 10*c* and the hole portion 2*b* can be machined easily.

The inside of the cylinder 10*c* is divided into two spaces by the large-area piston 10*b*. One of the spaces on the side of the small-area piston 10*a* is an atmospheric chamber 10*d*, and the other space is a pressure chamber 10*e*. The atmospheric chamber 10*d* communicates with the fuel tank 3 via a return line 11. On the other hand, the pressure chamber 10*e* communicates with the low-pressure line 9 via a branch pipe 13.

When starting the engine, the high-pressure fuel supply system thus constructed applies the rated discharge pressure of the low-pressure pump 4 to the pressure chamber 10*e* via the branch pipe 13. The large-area piston 10*b* presses and displaces the small-area piston 10*a* instantaneously. Thereby the length of the small-area piston 10*a* protruding into the reservoir 2 is increased. Because the volume of the reservoir 2 is reduced accordingly, fuel in the reservoir 2 is compressed. The pressure of fuel can be boosted to a predetermined pressure (e.g., 4 MPa) that is obtained by multiplying a discharge pressure of the low-pressure pump 4 by an area ratio $S_L/S_S$ between a cross-sectional area $S_L$ of the large-area piston 10*b* and a cross-sectional area $S_S$ of the small-area piston 10*a*, i.e., to a pressure far above the rated discharge pressure of the low-pressure pump 4. Thus, it becomes possible to perform fuel injection well when starting the engine.

In this embodiment, no sealing member for applying a great frictional force during sliding movements is disposed between the small-area piston 10*a* and the hole portion 2*b* or between the large-area piston 10*b* and the cylinder 10*c*. Thus, if a pressure is applied in the pressure chamber 10*e* when starting the engine, the small-area piston 10*a* is pressed and displaced instantaneously and the pressure of fuel in the reservoir 2 is boosted to the above predetermined pressure. Therefore, fuel injection can be started at an early stage.

However, since no sealing member is disposed as described above, it is possible that fuel in the pressure chamber 10*e* may leak to the atmospheric chamber 10*d* from a gap between the large-area piston 10*b* and the cylinder 10*c*. However, since the pressure chamber 10*e* is at the rated discharge pressure of the low-pressure pump 4, i.e., at a low pressure, such leakage of fuel is substantially prevented by suitably selecting a width of the gap. It is also possible that fuel in the reservoir 2 may leak to the atmospheric chamber 10*d* from a gap between the small-area piston 10*a* and the hole portion 2*b* due to a rise in pressure. However, the predetermined pressure at this moment is lower than the target high fuel pressure of the reservoir 2, and fuel leakage can be substantially prevented by suitably selecting a width of the gap.

Even in the case where a small amount of fuel has leaked to the atmospheric chamber 10*d* from the pressure chamber 10*e* and/or the reservoir 2, since the atmospheric chamber 10*d* communicates with the fuel tank 3 via the return line 11, the fuel is returned to the fuel tank 3 by gravity. Therefore, no problem is caused.

Figure 1B:
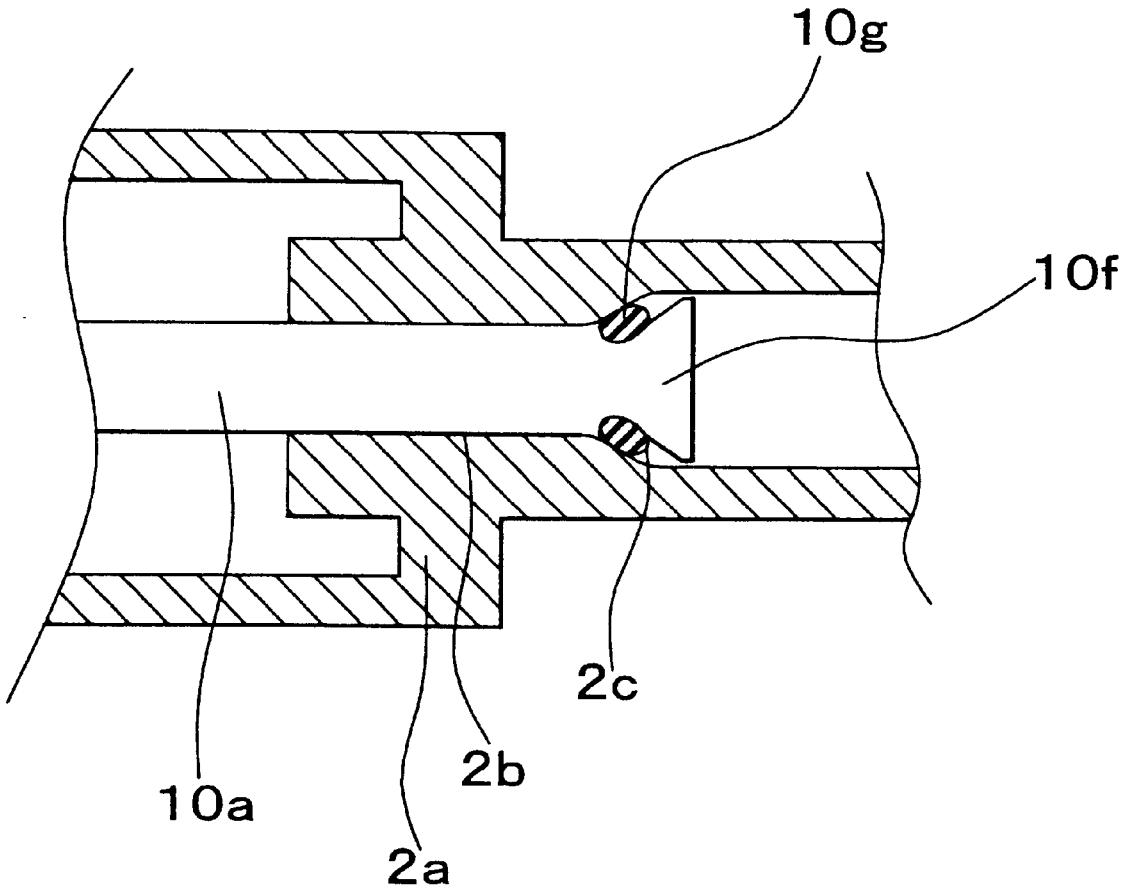
FIG. 1B is an enlarged view showing a part of the high-pressure fuel supply system shown in FIG. 1A in detail.

However, if the high-pressure pump 7 has operated normally after the starting of the engine and if the pressure of fuel in the reservoir 2 has reached a very high pressure close to the target high fuel pressure, fuel surely leaks from the gap between the small-area piston 10*a* and the hole portion 2*b* unless a sealing member is provided. Therefore, fuel leakage must be prevented. In this embodiment, as shown in FIG. 1B, the small-area piston 10*a* located in the reservoir 2 is provided at its end with an enlarged portion 10*f* that is concentric with the small-area piston 10*a* and that is in the shape of a truncated cone. An O-ring 10*g* as a sealing member is fitted into a groove that is formed in the enlarged portion 10*f* in such a manner as to extend around an axis thereof.

If the pressure of fuel in the reservoir 2 has reached the target high fuel pressure, the small-area piston 10*a* is pushed back against a pressure applied to the large-area piston 10*b*. At this moment, the O-ring 10*g* is compressed and comes into close contact with an inner wall surface 2*c* of the one wall portion 2*a* as well as the entire groove in the enlarged portion 10*f*. Thus, the hole portion 2*b* is sealed, and fuel leakage as described above can be prevented.

In this embodiment, the area ratio ($S_L/S_S$) between the large-area piston 10*b* and the small-area piston 10*a* is set such that a predetermined pressure lower than the target high fuel pressure in the reservoir 2 is applied to the small-area piston 10*a* in a balancing manner when the rated discharge pressure of the low-pressure piston 4 is applied to the large-area piston 10*b*. Thus, as soon as the pressure in the reservoir 2 reaches a pressure higher than the predetermined pressure due to the high-pressure pump 7, the small-area piston 10*a* is pushed back and sealing of the reservoir 2 is guaranteed. Thus, if the pressure in the reservoir 2 has reached a pressure close to the target high fuel pressure, more complete sealing of the reservoir 2 can be guaranteed.

In order to further improve fuel injection when starting the engine, the area ratio ($S_L/S_S$) between the large-area piston 10*b* and the small-area piston 10*a* may be further increased so that the above predetermined pressure becomes close to the target high fuel pressure.

Because fresh fuel is continuously supplied to the reservoir 2 from the fuel tank 3 while the engine is in operation, the temperature of fuel in the reservoir 2 is lower than the temperature of a reservoir housing. However, since no fresh fuel is supplied after the engine has been stopped, the temperature of fuel in the reservoir 2 becomes substantially equal to the temperature of the reservoir housing. Thus, immediately after the engine has been stopped, fuel in the reservoir 2 receives heat from the reservoir housing, is heated up, and expands thermally. Thereby the safety valve 12*a* in the return line 12 is operated, and the pressure of fuel in the reservoir 2 is maintained at a pressure close to the target high fuel pressure.

After that, although the temperature of fuel and of the reservoir housing gradually falls to an outside air temperature, fuel thermally contracts more greatly than the reservoir housing due to a difference in thermal expansion coefficient between the reservoir housing and fuel. Conventionally, at this moment, the pressure of fuel becomes negative and fuel vapors are generated in the reservoir 2. Thus, even if a pressure booster as described above has been operated when starting the engine, operation of the small-area piston 10*a* serves only to crush fuel vapors in the reservoir 2, and the pressure in the reservoir 2 cannot be boosted to a set pressure.

In this embodiment, in order to solve this problem, the reservoir 2 communicates with the fuel tank 3 via a communication pipe 14 in which a check valve 14*a* that allows fuel to flow only from the fuel tank 3 to the reservoir 2 is disposed. The check valve 14*a* is opened easily by a small differential pressure. Thus, if the pressure of fuel in the reservoir 2 becomes lower than an atmospheric pressure after the engine has been stopped, the check valve 14*a* is opened so that fuel flows from the fuel tank 3 into the reservoir 2 via the communication pipe 14 and that the pressure in the reservoir 2 is prevented from becoming negative. Therefore, no fuel vapors are generated in the reservoir 2. Thus, the pressure booster can reliably boost a pressure in the reservoir when starting the engine.

Figure 2:
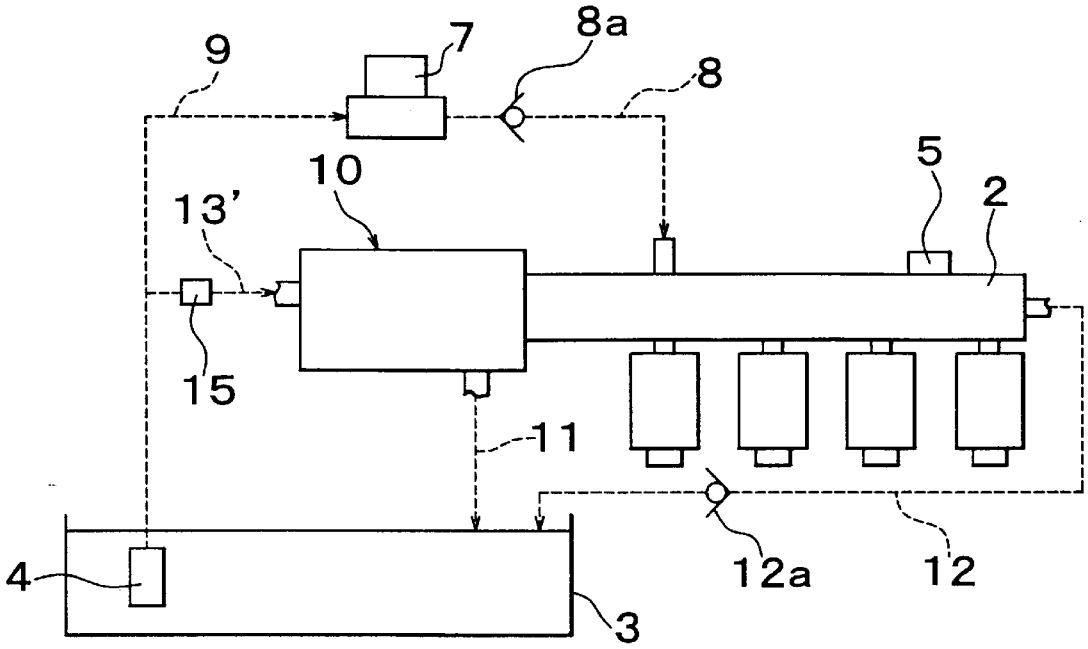
FIG. 2 is a schematic view of a high-pressure fuel supply system for fuel injection in an internal combustion engine according to a second embodiment of the invention.

FIG. 2 is a schematic view of a high-pressure fuel supply system for fuel injection in an internal combustion engine according to a second embodiment of the invention. In this embodiment, structural components identical with those of the first embodiment are denoted by the same reference numerals. The following description will be focused exclusively on differences between the second and first embodiments. In the second embodiment, although the communication pipe 14 via which the reservoir 2 communicates with the fuel tank 3 is not provided, a set pressure valve 15 that opens when the pressure on the side of the low-pressure pump 4 is equal to or higher than a set pressure is disposed in a branch pipe 13' for applying the rated discharge pressure of the low-pressure pump 4 to the pressure booster 10.

In this embodiment, when starting the engine, fuel vapors may be present in the reservoir 2. However, since the set pressure valve 15 is closed immediately after operation of the low-pressure pump has been started, the pressure booster 10 is out of operation. At this moment, the high-pressure pump 7 operates slowly due to cranking, and fuel from the low-pressure pump 4 flows into the reservoir 2 via the high-pressure pump 7. With the rated discharge pressure of the low-pressure pump 4 being equal to 0.3 MPa, the check valve 8*a* disposed in the high-pressure line 8 opens at a set pressure of, e.g., 0.1 MPa. On the other hand, the set pressure valve 15 opens at a pressure of, e.g., 0.2 MPa.

Thus, the pressure in the reservoir 2 first of all becomes equal to 0.1 MPa due to fuel discharged from the low-pressure pump 4, so that fuel vapors are eliminated completely. At this moment, the set pressure valve 15 is opened and the pressure booster 10 operates. Therefore, the pressure booster 10 can reliably boost a pressure in the reservoir when starting the engine.

The set pressure valve 15 can be a valve that is not a check valve and remains open when the pressure on the side of the low-pressure pump 4 is equal to or higher than a set pressure. Therefore, if the pressure of fuel in the reservoir 2 is increased while the engine is in operation, fuel is discharged from a pressure chamber of the pressure booster 10 toward the low-pressure pump 4 due to returning movements of the large-area and small-area pistons. This fuel is sucked by the high-pressure pump 7 via the branch pipe 13' or returned to the fuel tank 3. Further, in the case where a check valve that opens at a pressure of, e.g., 0.2 MPa is disposed in the branch pipe 13', instead of a set pressure valve, fuel in the pressure chamber of the pressure booster 10 flows around the large-area piston and into the atmospheric chamber and is returned to the fuel tank 3 via the return line 11.

In this embodiment, instead of a set pressure valve, a valve mechanism that opens in response to an operation signal from an electromagnetic valve or the like may be disposed in the branch pipe 13. In this case, in order to ensure that operation of the pressure booster is delayed at least until fuel vapors in the reservoir 2 are eliminated by fuel that is supplied to the reservoir 2 via the low-pressure pump 4, the valve mechanism may be opened after the lapse of a set time period or upon detection of a pressure of fuel in the reservoir 2 being at least equal to or higher than an atmospheric pressure, when starting the engine.

Figure 3:
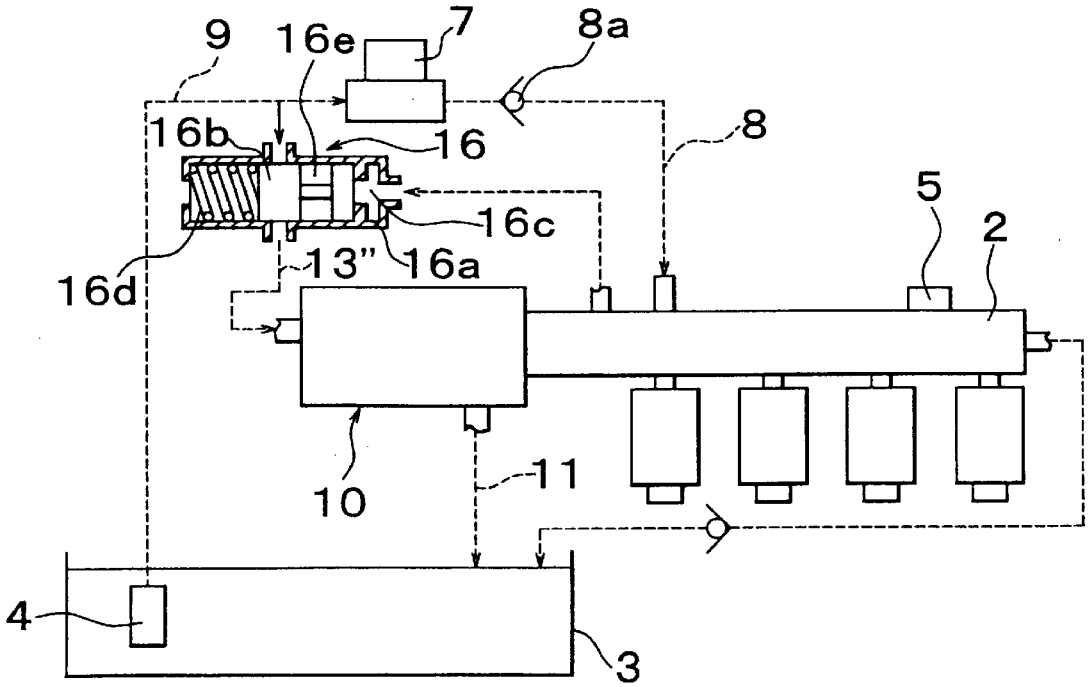
FIG. 3 is a schematic view of a high-pressure fuel supply system for fuel injection in an internal combustion engine according to a third embodiment of the invention.

FIG. 3 is a schematic view of a high-pressure fuel supply system for fuel injection in an internal combustion engine according to a third embodiment of the invention. In the third embodiment, structural components identical with those of the second embodiment are denoted by the same reference numerals. The following description will be focused exclusively on differences between the third and second embodiments. In the second embodiment, the set pressure valve 15 disposed in the branch line 13' opens if the pressure on the side of the low-pressure pump 4 becomes equal to a set pressure. In this embodiment, a set pressure valve 16 disposed in a branch pipe 13" opens if the pressure in the reservoir 2 becomes equal to a set pressure of, e.g., 0.2 MPa.

To be more specific, the set pressure valve 16 is provided with a piston 16*b* that is disposed in a cylinder 16*a*, a pressure chamber 16*c* that is formed in the cylinder 16*a* by the piston 16*b*, and a spring 16*d* that presses the piston 16*b* toward the pressure chamber 16*c*. The pressure chamber 16*c* communicates with the reservoir 2. A space 16*e* is formed around a central portion of the piston 16*b*. Thus, if the pressure chamber 16*c* that is equal in pressure to the reservoir 2 assumes a pressure of 0.2 MPa, the piston 16*b* moves while compressing the spring 16*d*, and the branch pipe 13" is opened via the space 16*e* formed in the piston 16*b*. The discharge pressure of the low-pressure pump 4 is then applied to the pressure chamber of the pressure booster 10, so that the pressure booster 10 is operated. Thus, as is the case with the second embodiment, operation of the pressure booster 10 is delayed at least until fuel vapors in the reservoir 2 are eliminated by fuel that is supplied to the reservoir 2 via the low-pressure pump 4, and the pressure booster 10 can reliably boost a pressure in the reservoir when starting the engine.

In the above second and third embodiments, prior to operation of the pressure booster 10 when starting the engine, fuel is caused to flow into the reservoir 2 via the high-pressure pump 7. As a matter of course, however, if a pipe branching off from the low-pressure line 9 is directly connected to the reservoir 2 and if the pipe is provided with a check valve that opens at a small differential pressure and that allows fuel to flow only from the low-pressure pump 4 to the reservoir 2, fuel can flow into the reservoir 2 from the low-pressure pump 4 via the pipe even while the check valve 8*a* in the high-pressure line 8 is being opened. Thus, fuel vapors in the reservoir 2 can be eliminated at an early stage.

Figure 4:
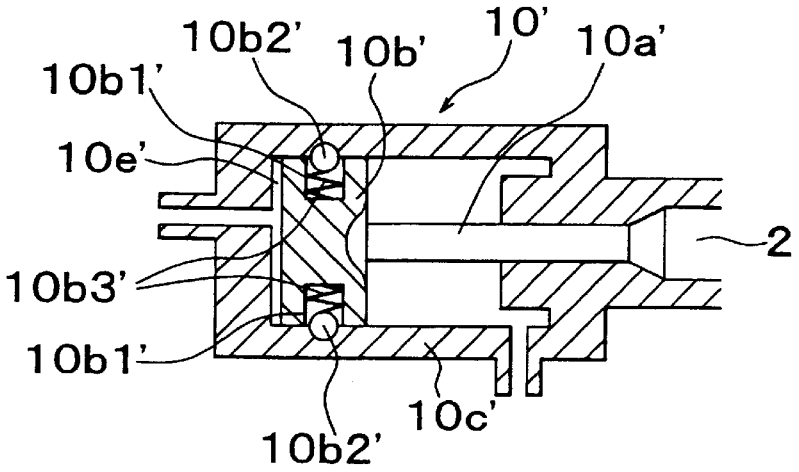
FIG. 4 is a cross-sectional view of a pressure booster employed in a high-pressure fuel supply system for fuel injection in an internal combustion engine according to a fourth embodiment of the invention.

FIG. 4 is a cross-sectional view of a pressure booster 10' applied to a high-pressure fuel supply system for fuel injection in an internal combustion engine according to a fourth embodiment of the invention. Structural components other than the pressure booster 10' are identical with those of the first embodiment. The following description will be focused exclusively on differences between the pressure booster 10' of this embodiment and the pressure booster 10 of the first embodiment. In the pressure booster 10', pressure boosting operation can be delayed at least until fuel vapors in the reservoir 2 are eliminated by fuel that is supplied to the reservoir 2 via the low-pressure pump 4. In the pressure booster 10', a large-area piston 10*b*' that abuts on a small-area piston 10*a*' is in the shape of a circular cylinder, and a plurality of hole portions 10*b*1' are formed radially around the large-area piston 10*b*'. Disposed in each of the hole portions 10*b*1' are a spherical member 10*b* that is partially fitted into the hole portion 10*b*1' and a spring 10*b*3' that urges the spherical member 10*b*2' outwards. A cylinder 10*c*' is provided with recesses into which the spherical members 10*b*2' are partially fitted in a state where the large-area piston 10*b*' is located at such a position that a pressure chamber 10*e*' assumes its minimum volume. Although the spherical members 10*b*2 shown in FIG. 4 are employed in this embodiment, there is no need to impose such limitation. For example, roller members with semicircular apices may be employed.

Thus, until the pressure in the pressure chamber 10*e*' reaches a pressure of, e.g., 0.2 MPa, the spherical members 10*b*2' that are urged outwards by the springs 10*b*3' are fitted in the recesses in the cylinder 10*c*' and stabilize the large-area piston 10*b*' against a pressing force applied to the large-area piston 10*b*'. Thus, operation of the pressure booster 10 is delayed at least until fuel vapors in the reservoir 2 are eliminated by fuel that is supplied to the reservoir 2 via the low-pressure pump 4. Thus, the pressure booster 10 can reliably boost a pressure in the reservoir when starting the engine.

Figure 5:
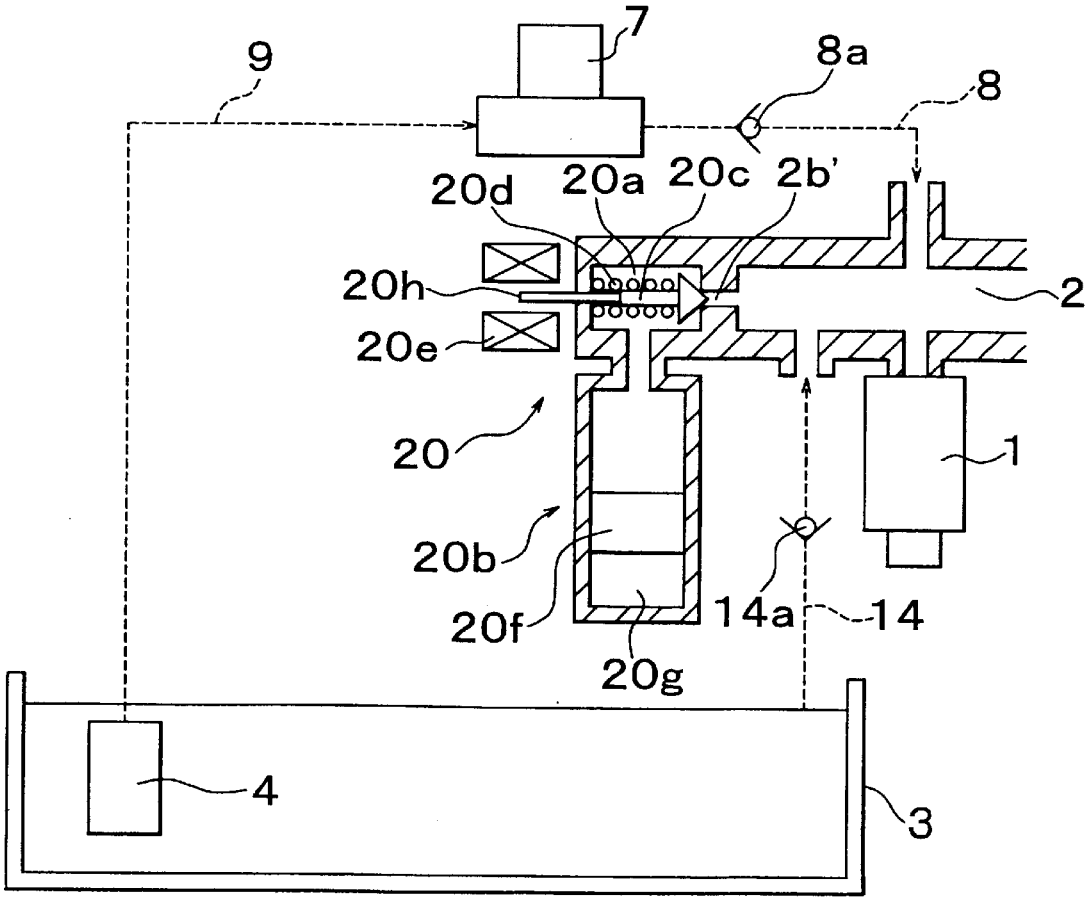
FIG. 5 is a schematic view of a high-pressure fuel supply system for fuel injection in an internal combustion engine according to a fifth embodiment of the invention.

FIG. 5 is a schematic view of a high-pressure fuel supply system for fuel injection in an internal combustion engine according to a fifth embodiment of the invention. In the fifth embodiment, structural components identical with those of the first embodiment are denoted by the same reference numerals. The following description will be focused exclusively on differences between the fifth and first embodiments. A pressure booster 20 of this embodiment is not of a piston type but of an accumulator type. To be more specific, the pressure booster 20 has a control chamber 20*a* leading to an opening 2*b*' of the reservoir 2 and an accumulator 20*b* leading to the control chamber 20*a*. Disposed in the control chamber 20*a* are a valve body 20*c* that allows the opening 2*b*' to be closed and a spring 20*d* that urges the valve body 20*c* in its closing direction. The valve body 20*c* has a rod 20*h* that extends outside the control chamber 20*a* in an oil-sealing manner, and a solenoid 20*e* is disposed around the rod 20*h*. The accumulator 20*b* has a piston 20*f*, and gases such as nitrogen are encapsulated in a pressure chamber 20*g* that is closed by the piston 20*f*.

If the pressure in the reservoir 2 has reached a high pressure during engine operation due to such a construction, the valve body 20*c* is opened easily and the control chamber 20*a* becomes equal in pressure to the reservoir 2. This pressure is applied to the piston 20*f* so that nitrogen in the pressure chamber 20*g* is compressed to the same pressure. Merely by a slight fall in pressure in the reservoir 2, the valve body 20*c* closes the opening 2*b*'. Thus, when the engine is stopped, the pressure chamber 20*g* of the accumulator 20*b* is maintained at a maximum pressure in the reservoir 2 during engine operation. When starting the engine, if the valve body 20*c* is opened by the solenoid 20*e*, the pressure accumulated in the pressure chamber 20*g* of the accumulator 20*b* presses fuel in the control chamber 20*a* into the reservoir 2. Thus, it becomes possible to boost a pressure in the reservoir 2.

Also in this embodiment in which a pressure booster such as the pressure booster 20 is provided, since the reservoir 2 communicates with the fuel tank 3 via the communication pipe 14 as is the case with the first embodiment, no fuel vapors are generated in the reservoir 2 when starting the engine. Even in the case where the communication pipe 14 is not provided, if the opening of the valve body 20*c* by the solenoid 20*e* is delayed at least until fuel vapors in the reservoir 2 are eliminated by fuel that is supplied to the reservoir 2 via the low-pressure pump 4 when starting the engine based on the same idea as in the second and third embodiments, the pressure booster 20 can reliably boost a pressure in the reservoir when starting the engine.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A high-pressure fuel supply system comprising:

a reservoir for supplying fuel injection valves of an internal combustion engine with high-pressure fuel;

a pressure pump that boosts a pressure of fuel that has been withdrawn from a fuel tank and that force-feeds the fuel to the reservoir;

a pressure booster that boosts a pressure of fuel in the reservoir when starting the internal combustion engine; and a fuel passage that connects the fuel tank to the reservoir and that allows fuel to flow only from the fuel tank to the reservoir.

2. The high-pressure fuel supply system according to claim 1, wherein the pressure pump comprises:

a low-pressure pump that withdraws fuel from the fuel tank and that discharges fuel at a pressure substantially equal to or higher than a predetermined pressure since the starting of the internal combustion engine; and a high-pressure pump that turns low-pressure fuel supplied from the low-pressure pump into high-pressure fuel and that force-feeds the high-pressure fuel to the reservoir.

3. The high-pressure fuel supply system according to claim 2, wherein the pressure booster increases a pressure in the reservoir by using a discharge pressure of the low-pressure pump.

4. The high-pressure fuel supply system according to claim 3, wherein:

the pressure booster has a large-area piston and a small-area piston;

a pressure of fuel discharged by the low-pressure pump is applied to the large-area piston; and the small-area piston acts on the reservoir and boosts a pressure of fuel in the reservoir.

5. The high-pressure fuel supply system according to claim 4, wherein a sealing member is provided at an apex portion of the small-area piston that acts on the reservoir.

6. The high-pressure fuel supply system according to claim 1, wherein the fuel passage is provided with a check valve that allows fuel to flow only from the fuel tank to the reservoir.

7. The high-pressure fuel supply system according to claim 1, wherein the pressure booster boosts a pressure of fuel in the reservoir by using an accumulator filled with a pressurized gas.

8. The high pressure fuel supply system according to claim 1, wherein fuel flows through the fuel passage from the fuel tank to the reservoir to avoid formation of fuel vapor in the reservoir.

9. A high-pressure fuel supply system comprising:

a reservoir that supplies fuel injection valves of an internal combustion engine with high-pressure fuel;

a pressure pump that boosts a pressure of fuel that has been withdrawn from a fuel tank and that force-feeds the fuel to the reservoir;

a pressure booster that boosts a pressure of fuel in the reservoir when starting the internal combustion engine; and a delay device that delays operation of the pressure booster at least until fuel vapors in the reservoir are eliminated.

10. The high-pressure fuel supply system according to claim 9, wherein the pressure pump comprises:

a low-pressure pump that withdraws fuel from the fuel tank and that discharges fuel at a pressure substantially equal to or higher than a predetermined pressure since the starting of the internal combustion engine; and a high-pressure pump that turns low-pressure fuel supplied from the low-pressure pump into high-pressure fuel and that force-feeds the high-pressure fuel to the reservoir.

11. The high-pressure fuel supply system according to claim 10, wherein the delay device includes a valve interposed between the low-pressure pump and the pressure booster that delays operation of the pressure booster.

12. The high-pressure fuel supply system according to claim 11, wherein the valve is a set pressure valve that opens at a pressure equal to or higher than a preselected pressure.

13. The high-pressure fuel supply system according to claim 11, wherein the valve is a check valve that makes backward flow impossible.

14. The high-pressure fuel supply system according to claim 11, wherein the valve is an electromagnetic valve having a solenoid.

15. The high-pressure fuel supply system according to claim 10, wherein the delay device includes a valve that is interposed between the low-pressure pump and the pressure booster and delays operation of the pressure booster by applying a high fuel pressure in the reservoir to the valve.

16. The high-pressure fuel supply system according to claim 15, wherein the valve is a set pressure valve that opens at a pressure equal to or higher than a preselected pressure.

17. The high-pressure fuel supply system according to claim 10, wherein the pressure booster increases a pressure in the reservoir by using a discharge pressure of the low-pressure pump.

18. The high-pressure fuel supply system according to claim 17, wherein:

the pressure booster has a large-area piston and a small-area piston;

a pressure of fuel discharged by the low-pressure pump is applied to the large-area piston; and the small-area piston acts on the reservoir and boosts a pressure of fuel in the reservoir.

19. The high-pressure fuel supply system according to claim 18, wherein:

the pressure booster also serves as the delay device; and operation of the pressure booster is delayed by temporarily stopping sliding of the large-area piston and temporarily holding the large-area piston in a predetermined position when the large-area piston receives a pressure of fuel that has been discharged by the low-pressure pump.

20. The high-pressure fuel supply system according to claim 19, wherein:

a plurality of pairs of balls and springs or a plurality of pairs of rollers and springs are interposed between an outer periphery of the large-area piston and an inner periphery of a cylinder provided in the pressure booster; and the inner periphery of the cylinder has recesses into which the balls or the rollers are partially fitted.

21. A method of supplying high-pressure fuel, comprising the steps of:

boosting a pressure of fuel that has been withdrawn from a fuel tank by a pressure pump and force-feeding the fuel to a reservoir;

boosting a pressure of fuel in the reservoir when starting an internal combustion engine; and supplying high-pressure fuel to fuel injection valves of the internal combustion engine from the reservoir; wherein:

generation of fuel vapors in the reservoir is prevented by providing a fuel passage that allows fuel to flow only from the fuel tank to the reservoir.

22. The method according to claim 21, wherein:

the pressure pump is comprised of at least a low-pressure pump and a high-pressure pump;

the low-pressure pump withdraws fuel from the fuel tank and discharges fuel at a pressure substantially equal to or higher than a predetermined pressure since the starting of the internal combustion engine; and low-pressure fuel supplied from the low-pressure pump is sent to the high-pressure pump, turned into high-pressure fuel, and force-fed to the reservoir.

23. A method of supplying high-pressure fuel, comprising the steps of:

boosting a pressure of fuel that has been withdrawn from a fuel tank by a pressure pump and force-feeding the fuel to a reservoir;

boosting a pressure of fuel in the reservoir when starting an internal combustion engine; and supplying high-pressure fuel to fuel injection valves of the internal combustion engine from the reservoir; wherein:

the boosting of the pressure is delayed at least untilfuel vapors in the reservoir are eliminated.

24. The method according to claim 23, wherein:

the pressure pump is comprised of at least a low-pressure pump and a high-pressure pump;

the low-pressure pump withdraws fuel from the fuel tank and discharges fuel at a pressure substantially equal to or higher than a predetermined pressure since the starting of the internal combustion engine; and low-pressure fuel supplied from the low-pressure pump is sent to the high-pressure pump, turned into high-pressure fuel, and force-fed to the reservoir.

* * * * *